US005340180A

United States Patent [19]

Chase et al.

[11] Patent Number: 5,340,180

[45] Date of Patent: Aug. 23, 1994

[54] APPARATUS FOR SECURING CONTAINED MATERIAL

[75] Inventors: William L. Chase, Des Moines; David W. Perkins, Hiawatha, both of Iowa

[73] Assignee: Paper Systems, Inc., Des Moines, Iowa

[21] Appl. No.: 739,497

[22] Filed: Aug. 1, 1991

[51] Int. Cl.[5] ..... B65D 19/26

[52] U.S. Cl. ..... 294/68.1; 294/67.4; 108/55.5

[58] Field of Search ..... 294/68.1, 67.1, 67.4, 294/74; 414/607, 608; 108/51.1, 55.1, 55.5

[56] References Cited

U.S. PATENT DOCUMENTS

| | | | |
|---|---|---|---|
| 1,614,705 | 1/1927 | Amsler | 294/68.1 |
| 1,834,902 | 12/1931 | Payzant | 294/67.4 |
| 2,687,321 | 8/1954 | Toffolon | 294/74 |
| 2,698,696 | 1/1955 | Strong . | |
| 2,913,206 | 11/1959 | Paris . | |
| 2,977,148 | 3/1961 | Ford | 294/74 |
| 3,204,798 | 9/1965 | Becker | 294/67.1 X |
| 3,315,800 | 4/1967 | Wagner | 108/55.5 X |
| 3,425,472 | 2/1969 | Marino | 294/68.1 X |
| 3,524,543 | 8/1970 | Bundy et al. | 294/67.4 X |
| 3,844,600 | 10/1974 | Jay | 294/68.1 X |
| 4,042,127 | 8/1977 | Brossia | 108/51.3 |
| 4,378,743 | 4/1983 | McFarland | 108/51.3 |
| 4,723,327 | 2/1988 | Smith . | |
| 4,834,439 | 5/1989 | van de Kamp | 294/74 |

FOREIGN PATENT DOCUMENTS

| | | | |
|---|---|---|---|
| 81463 | 3/1953 | Norway | 294/67.4 |
| 212396 | 4/1967 | Sweden | 294/67.4 |

*Primary Examiner*—Joseph D. Pape

*Attorney, Agent, or Firm*—Merchant, Gould, Smith, Edell, Welter & Schmidt

[57] ABSTRACT

Apparatus for securing a container to a buffering mechanism with a binding member. The buffering mechanism has a plurality of cleats at the corners thereof, each with an aperture for receiving a banding member which is threaded through the cleats and wrapped around the contained material in a "saddle-strapping" pattern. In another embodiment, the buffering member includes a platform with holes therethrough, and the banding member is threaded through the holes to pass under the platform and wrap around the container to secure it thereto.

1 Claim, 3 Drawing Sheets

APPARATUS FOR SECURING CONTAINED MATERIAL

FIELD OF THE INVENTION

The present invention is directed to cardboard or other paper-type containers and, more particularly, to apparatus including not only the container, but also a member under the container with banding securing the under-member and the cover of the container at opposite ends as a unit.

BACKGROUND OF THE INVENTION

Cardboard boxes containing heavy loads are moved about a warehouse with a two-wheeler or with a forklift or by being placed on a pallet and then moved by forklift. Extreme care is needed so that the chisel element of the two-wheeler or of the forklift does not puncture the cardboard box.

Sometimes, powders or liquids are contained within a bag inside the box or other flowable substances are contained therein so that if the box tips, the cover will likely come off or open and the contents spill. A need exists for apparatus which will both protect the bottom of such containers and also secure the covers.

Metal banding for boxes is known. Wooden pallets are known. Additionally, concepts such as the cargo binder of U.S. Pat. No. 2,687,321 are used. The binder has a plurality of flexible legs held together by a variety of straps to bind several bagged items.

Also, slings such as shown in U.S. Pat. No. 4,834,439 are known. The sling includes a load supporting bottom connected to straps which each support a plurality of boxes on two sides adjacent a corner of the stacked boxes. The sling is engaged at the top to lift the load.

The art, however, does not teach a simple buffering mechanism for the bottom of a container, and which is securely banded to the cover of the container to create a single unit which can be easily moved both intra-warehouse and extra-warehouse.

SUMMARY OF THE INVENTION

The present invention is directed to apparatus for maintaining contained materials secure when engaged by a moving mechanism having a chisel element. The apparatus of the invention includes a container, buffering mechanism for the container, and mechanism for banding the buffering mechanism to the container so that the buffering mechanism and the cover form opposite ends and are held securely in place when the entire unit is engaged by the moving mechanism.

The buffering mechanism of the present invention in a first embodiment includes a pad with a plurality of cleats at corners thereof and forming a unitary member. The various cleats have apertures for receiving a band member so that when the band member is installed as taught herein, the pad and cover for the container are secured at opposite ends of the container by the band member.

In another embodiment, the buffering mechanism includes a platform member with or without runners. The platform member may be fastened to the pad, or cleats may be fastened between the platform member and the runners. The banding mechanism may be threaded through apertures in the cleats or may extend through apertures in the platform member or along grooves in the runners and slots therebetween to pass under the platform member.

The cleats serve to prevent the container from "walking" off the pad or platform member as a result of natural vibration during shipping.

The buffering mechanism shields the container from the chisel element of usual devices used in warehouse to move containers from place to place.

The banding pattern and method of the present invention leads to as much as a 40% savings of banding material over the present industry standard.

The concept of securing the buffering mechanism and the cover at opposite ends of a container with banding provides not only for reliable moving within a warehouse prior to shipping, but also makes loading of the unit onto a transport vehicle easy, and subsequent unloading at a destination just as easy, as well as providing for moving in the usual fashion within the warehouse at the destination end. Thus, the present invention secures and protects a container throughout its transport life in an efficient fashion.

DETAILED DESCRIPTION OF THE INVENTION

Figure 1:
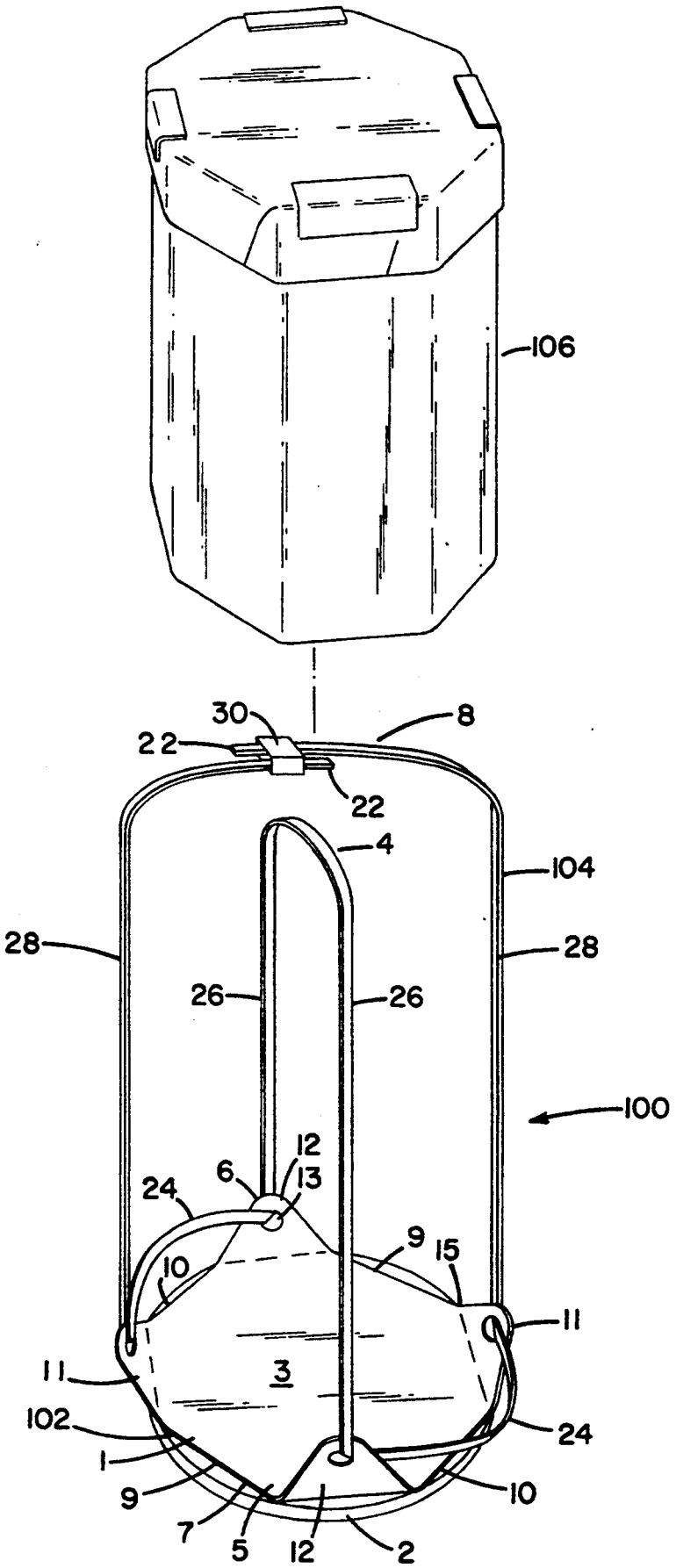
FIG. 1 is an exploded, perspective view of apparatus in accordance with the present invention.

With reference to the drawing wherein identical parts are designated by like reference numerals and corresponding parts in different embodiments by like reference numerals primed throughout the several views, an apparatus in accordance with the present invention is designated in FIG. 1 generally by the numeral 100. Apparatus 100 includes buffering mechanism 102 and mechanism 104 for banding a container 106 to the buffering mechanism 102.

As depicted in FIG. 1, the buffering mechanism includes a fibrous paper pad 1 and a rolling disk 2 which may be made of, for example, plywood. Pad 1 functions to deflect any chiseling-type member of a two-wheeler, a forklift, or any other common warehouse moving device from ripping or breaking the bottom of a cardboard container. The rolling disk 2 is a further aid in that regard. Furthermore, the rolling disk 2 easily allows a worker to tip a carton at an angle and roll it on the edge of the rolling disk to move in that fashion. Rolling disk 2 is fastened to the downwardly-facing surface 7 of pad 1 with any suitable fastening mechanism, for example, a suitable glue.

Pad 102 includes a central portion 3 with an upwardly-facing support surface 5, a downwardly-facing support surface 7, first and second pairs of parallel opposing edges 9, 10 and cleats 6 with upwardly extending portions 11, 12 having apertures 13 therethrough, preferably with a resilient hinging mechanism 15 for the flap portions 11, 12 to the central portion 3. The hinging mechanism 15 may be, for example, a scored groove in the paper to facilitate bending of the flap portion.

Pad 1 is preferably substantially square- or rectangular-shaped. The flap portions 11 and 12 are at each corner of the central portion 3, with members of the first pair 11 and the second pair 12 positioned at opposite corners. The hinging mechanism 15 of the flap portions 11 and 12 extends diagonally between a first edge 9 and a second edge 10 of the central portion 3.

The banding mechanism 104 is preferably a one piece member that is inserted or threaded through the apertures 13 of the flap portions 11 and 12, wrapped around the contained material in a "saddle-strapping" configuration, and joined together at the ends 22 to secure the contained material to the buffering mechanism 102.

The banding member 104 is threaded through the apertures 13 in adjacent flap portions 11, 12 to provide two horizontal band segments 24 substantially parallel with the first pair of edges 10 of buffering mechanism 102 and continuous with four substantially parallel, vertical band segments (identified as pairs 26, 28), one from each flap portion 11, 12, the vertical alignment of the band segments 24 and 26 being relative to the horizontal plane of the central portion 3 of the buffering mechanism 102. As diagonal opposites, members of the first pair 26 and of the second pair 28 of vertical band segments are connected together and correspond with flap portions 12 and flap portions 11, respectively. Members of the first pair of vertical band segments 26 form a unitary and continuous band along a first upper segment 4 extending over the top of the container. The ends 22 of the members of the second pair 28 of vertical band segments are secured adjacent each other and are connected at 30, as for example, by clamping, clasping, or soldering along a second upper segment 8 extending over the top of the container.

Having the flap portions 11, 12 of cleats 6 with apertures 13 therein available so that the banding member can be oriented as described has resulted in approximately a 40% savings of banding material as compared with conventional banding configurations which extend under the bottom of the container and include more than one connecting mechanism.

Figure 2:
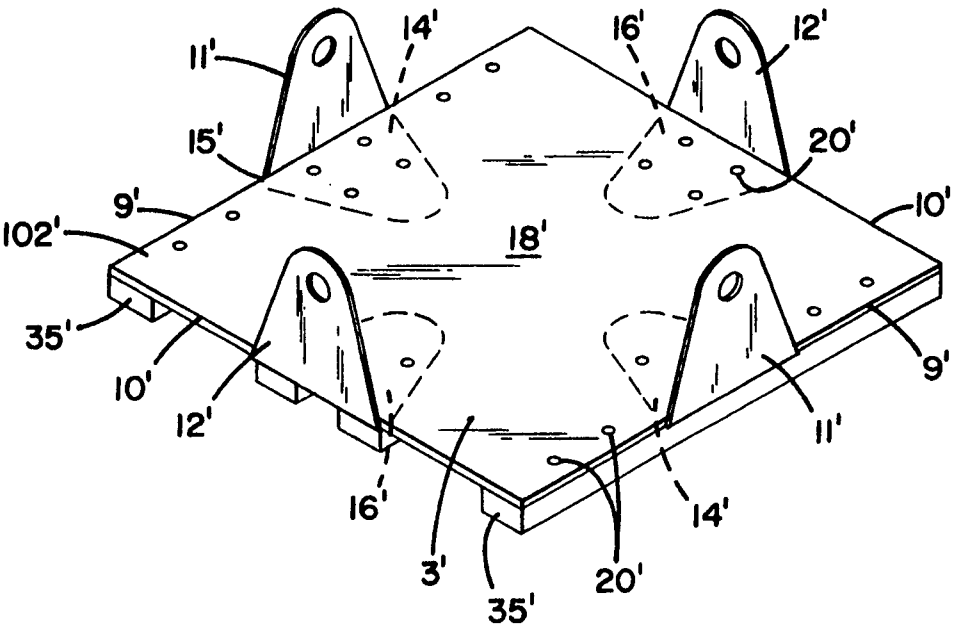
FIG. 2 is a perspective view of an alternate embodiment of the buffering mechanism with flap portions at the sides.

In an alternate embodiment, as shown in FIGS. 2, the flap portions 11' and 12' are upper flap portions having corresponding lower flap portions 14' and 16', both of which are positioned along the edges, or sides 9' and 10', of the central portion 3' of the buffering mechanism 102', with the hinging mechanism 15' extending adjacent and parallel to the edges 9' and 10' of the central portion 3'. Members of the first pair 11' and second pair 12' of flap portions are at opposite edges of the central portion 3'.

Buffering mechanism 102' is a platform member 18' made of cardboard, plywood, or other suitable material. Wood runners 35' extend from opposite edges 9' and are spaced in a fashion appropriate to receive the chisel members of a forklift. Platform member 18' is fastened to runner 35' with the lower flap portions 14' and 16' being sandwiched between. Typically, nails 20' are the fastening mechanism of choice, although glue and other fastening mechanisms are also appropriate.

Figure 3:
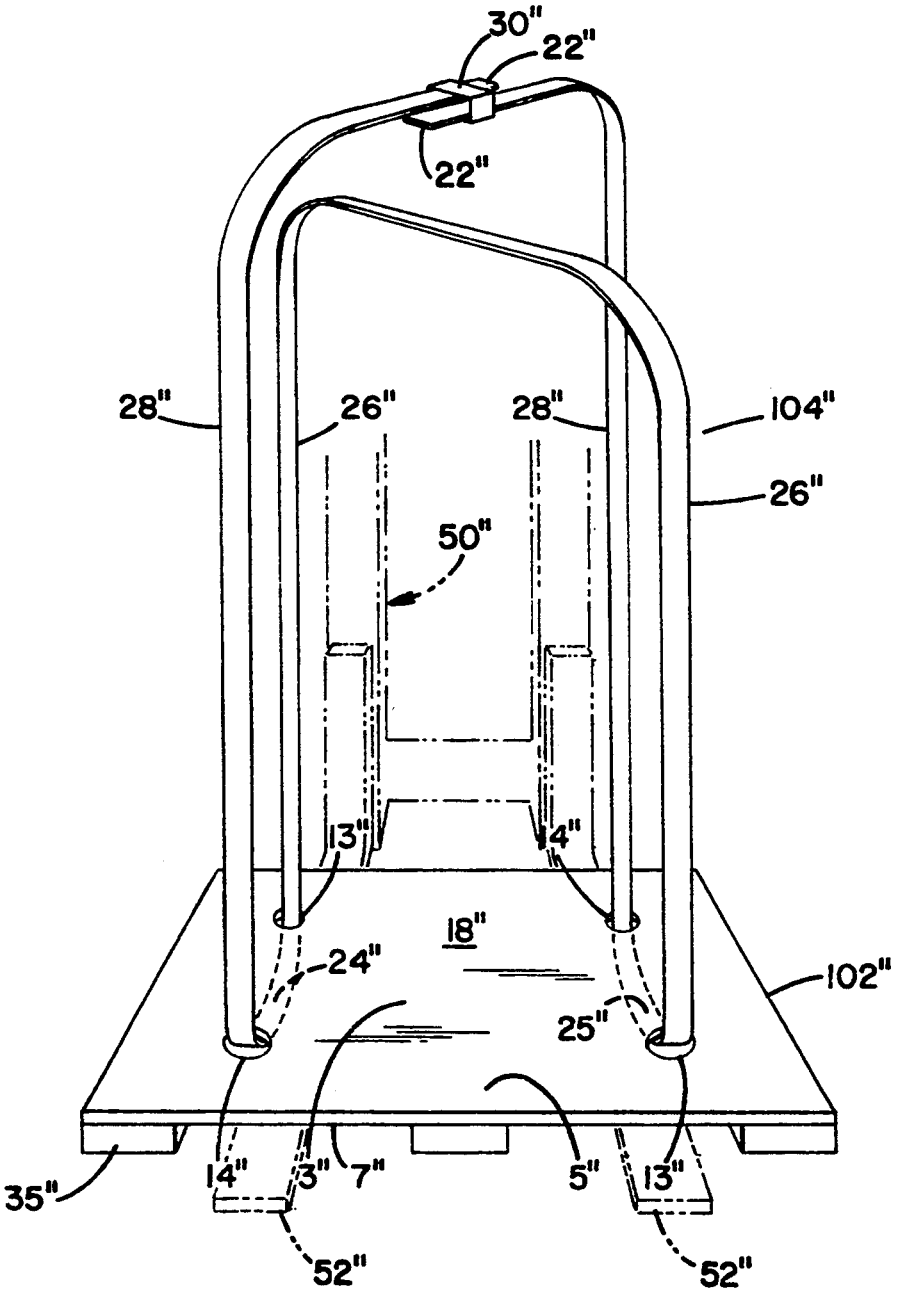
FIG. 3 is a perspective view of another embodiment of the apparatus depicting buffering mechanism with apertures through the platform member, and banding member.

In the preferred and alternate embodiments discussed above, the container is secured to the buffering mechanism by wrapping the horizontal band segments breadthwise along either side of the container, and the vertical band segments at spaced at intervals lengthwise along the container. In a third embodiment of the apparatus, as shown in FIG. 3, the central portion 3'' of the buffering mechanism 102'' has two pairs of apertures 13'' and 14'' in locations roughly corresponding to where similar apertures were located in the first two embodiments in the cleats. The apertures 13'' and 14'' extend through the platform member 18'' from the upwardly-facing support surface 5'' to the downwardly-facing support surface 7''. Platform member 18'' is fastened in a fashion as discussed adequately herein before to a plurality of runners 35''.

As depicted, the banding member 104'' is threaded through members of the first pair 13'' and the second pair 14'' of apertures to provide, respectively, first and second horizontal band segments 24'' and 25'', respectively, extending adjacent the downwardly-facing support surface 7'' of the central portion 3'' of the buffering mechanism 102''. The horizontal band segments 24'' and 25'' are in continuous and unitary connection with a first pair 26'' and second pair 28'' of vertical band segments, which extend generally vertically relative to the horizontal plane of the platform member 18'', one from each of apertures 13'' and 14''. Members of the first pair 26'' and second pair 28'' of vertical band segments are positioned diagonally opposite each other lengthwise along the container. Members of the first pair of vertical band segments 26'' are in continuous and unitary connection with one another via a first upper segment extending over the top of the container. Members of the second pair of vertical band segments 28'' have ends 22'' joined adjacent each other by connecting mechanism 30'' along a second upper segment extending over the top of the container.

Figure 4:
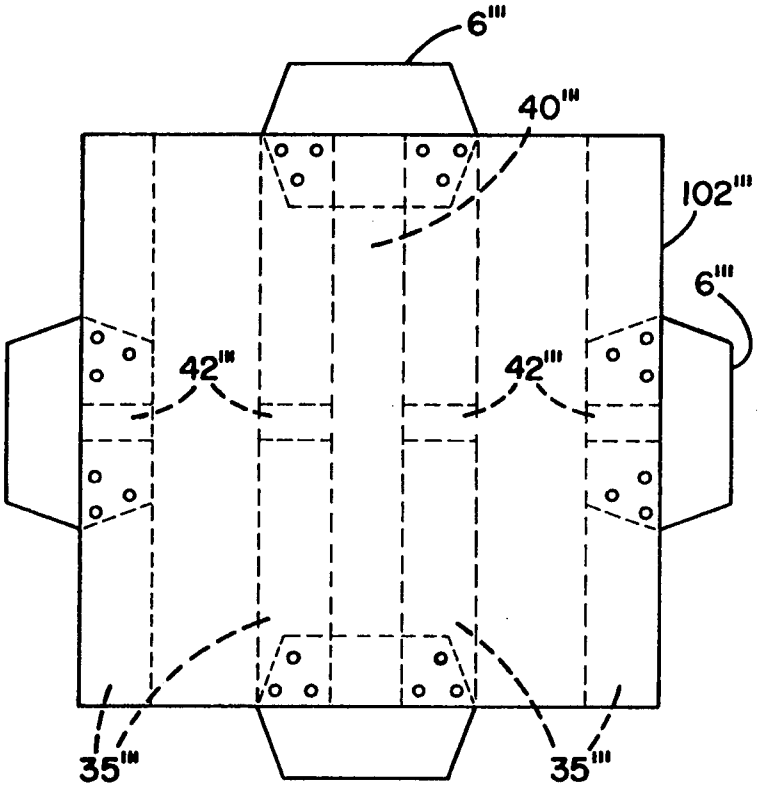
FIG. 4 is a top plan view of still another embodiment of the buffering mechanism.

As further illustrated in FIG. 4, buffering 102''' can take a form similar to the embodiment shown in FIG. 2, except that there are no apertures in cleats 6''' and there is a slot 40''' between the two interior runners 35''' and a transverse groove 42''' in all runners 35''' halfway between the opposite ends of the runners 35'''. With this embodiment, two banding members are used. One banding member extends along slot 40''' and around the cleats 6''' at the opposite end of slot 40'''. This first banding member then goes up over the container which would be located on buffering mechanism 102''' and fastened as discussed adequately herein before. The second banding member would extend through slots 42''' and around the cleats 6''' at the opposite sides of the side runners 35'''. Similarly, the second banding member would extend up over the container and also be fastened. Although this embodiment does not realize the efficiency of the banding pattern associated with the other embodiments described herein, it accomplishes holding and retaining the buffering mechanism to the container during the vibration of shipping by virtue of the cleats.

The buffering mechanism is preferably composed of a fibrous paper product as indicated earlier, such as, fiberboard or fiberpaper, but may also be made from corrugated cardboard, or other rigid or semi-rigid material capable of supporting a load of contained material. To provide additional support, a paper product pad or platform member may include a stiffening member which is placed adjacent and/or attached to either surface of the cradle. Furthermore, apparatus 100 may include a plurality of runners 35 to provide rigid support and more easily accommodate entry of a chisel element 52'' of a moving means 50'', as depicted in FIG. 3, as for example, tines of a forklift truck. A mechanism for slidable movement of the apparatus, such as casters, may also be attached.

Thus, the invention has been described with reference to various specific and preferred embodiments and techniques. However, it should be understood that many variations and modifications may be made while remaining within the spirit and scope of the invention.

What is claimed is:

1. Apparatus for maintaining contained material secure when engaged by means for moving said apparatus, said moving means having a chisel element for inserting under said apparatus, said apparatus comprising:

a container with a bottom, sidewalls and a cover;

means for buffering said container from said chisel element, said buffering means including a platform member and runners, said platform member including apertures therein; and means for banding said buffering means to said container so that said buffering means and said cover form opposite ends of said apparatus and are held securely in place when said apparatus is engaged by said moving means said banding means including a banding member; said banding member having opposite ends and means for connecting said ends together, said banding member being threadably engaged through said apertures to provide a pair of lower horizontal band segments and first and second pairs of vertical band segments, said lower horizontal band segments being continuous and unitary with said first and second pairs of vertical band segments which extend upwardly from said apertures, each segment of said first pair and each segment of said second pair of vertical band segments being at diagonally opposite positions along said container with respect to the other segment of said respective pair, said first pair of vertical band segments being continuous and unitary with one another via a first upper segment extending over the top of said container, said second pair of vertical band segments having said ends secured by said connecting means along a second upper segment extending over the top of said container.

* * * * *